United States Patent [19]

Bascom et al.

[11] 4,416,935

[45] Nov. 22, 1983

[54] BULKED EXTENSIBLE WEFT YARN SUITABLE FOR USE AS TIRE CORDS

[75] Inventors: Laurence N. Bascom, Amelia, Va.; Peter S. K. Leung, Wilmington, Del.

[73] Assignee: E. I. Du Pont de Nemours & Co., Wilmington, Del.

[21] Appl. No.: 330,003

[22] Filed: Dec. 11, 1981

[51] Int. Cl.[3] ..... D02G 3/04; D02G 3/34; D02G 3/48; D03D 15/08

[52] U.S. Cl. ..... 428/229; 57/226; 57/227; 57/246; 57/908; 139/420 A; 139/422; 152/358; 152/359; 428/231; 428/259

[58] Field of Search ..... 57/246, 226, 227, 908; 28/271; 139/420 A, 422; 152/358, 359; 428/229, 231, 259

[56] References Cited

U.S. PATENT DOCUMENTS

| | | | |
|---|---|---|---|
| 2,852,906 | 9/1958 | Breen . | |
| 3,395,744 | 8/1968 | Wolf et al. . | |
| 3,433,008 | 3/1969 | Gage . | |
| 3,538,701 | 11/1970 | Cannon | 57/246 |
| 3,677,318 | 7/1972 | Glass et al. . | |
| 4,024,895 | 5/1977 | Barron . | |
| 4,069,657 | 1/1978 | Bascom et al. . | |
| 4,248,036 | 2/1981 | Barron | 57/244 |

OTHER PUBLICATIONS

*Research Disclosure,* Feb. 1980, pp. 58–59, No. 19007, "Chemically Stabilized Extensible Weft Yarn for Radial Tires".

*Primary Examiner*—James C. Cannon

[57] ABSTRACT

A bulked extensible yarn of entangled convoluted undrawn synthetic continuous nylon filaments having a plurality of crunodal filament loops randomly spaced along its surface and a greige break elongation of at least 150% performs effectively as an extensible weft yarn in tire cord fabrics for single ply radial tires.

10 Claims, 1 Drawing Figure

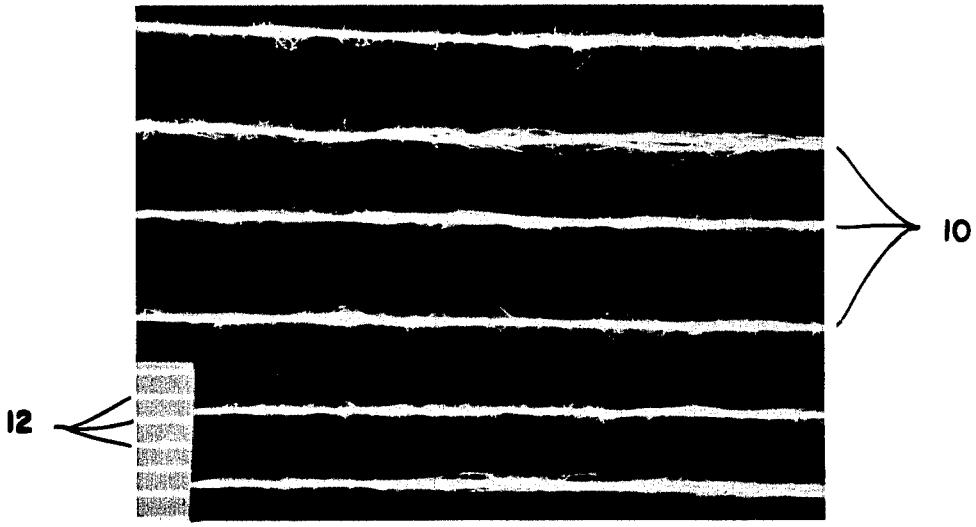
10
12

BULKED EXTENSIBLE WEFT YARN SUITABLE FOR USE AS TIRE CORDS

DESCRIPTION

1. Technical Field

This invention relates to a novel nonelastic extensible weft (or pick) yarn, and more specifically of the type used with tire cords in fabrics for reinforcing pneumatic tires, especially in single ply, radial tire constructions.

2. Background Art

Extensible weft yarns in fabrics of tire cords facilitate the construction of more uniform radial ply tires as taught in U.S. Pat. Nos. 3,395,744 (Wolf et al.); 3,677,318 (Glass et al.); and 4,024,895 (Barron). Such extensible weft yarns help to maintain a uniform spacing between the reinforcing warp cords by extending as the space between the cords increases when a cylindrical green tire carcass is being expanded into a toroidal shape prior to molding.

One extensible weft yarn presently being used in the trade consists of a core spun yarn having an extensible, thermally stabilized, undrawn nylon core yarn with a spun covering of staple fibers such as cotton. Such a yarn is taught in Research Disclosure, Feb. 1980, pages 58–59, Item 19007. According to the above mentioned U.S. Pat. No. 3,677,318 the high modulus sheath fibers of such core spun yarns restrict the stretchability of the core component during processing in weft winding, weaving and during fabric transportation and preparation so that a fabric with this weft yarn can be satisfactorily made into rolls which remain stable during handling, shipping and storage.

The commercial use of the core spun extensible weft yarns is hampered, among other things, by the expense of core spinning as well as the need for special core spinning equipment which most tire manufacturers do not have.

BRIEF DESCRIPTION OF THE FIGURE

The FIGURE is a photomicrograph (about 4X magnification) of several sections of a bulked undrawn yarn of the invention and a portion of a millimeter scale. See Example 2.

DISCLOSURE OF THE INVENTION

An object of this invention is an improved extensible weft yarn for tire cord fabrics, especially fabrics for single ply radial tires, which is comprised of undrawn synthetic continuous polyamide filaments, can be made simply and inexpensively, and can provide uniform tires.

This and other objects are fulfilled by an extensible bulked yarn consisting essentially of entangled, individually convoluted, undrawn, synthetic, continuous filaments of poly(hexamethylene adipamide) or of poly(epsilon-caproamide) and characterized by a multitude of stable crunodal filament loops spaced along the yarn surface and by a yarn elongation at break of at least 150%. Preferred yarns retain an elongation at break of at least 100% after being heated under tension (e.g., at constant length) in air at 440° F. (227°) for two minutes.

The preparation of fabrics of polyester and aramid tire cords can involve heating as much as 2 min. at 470° F. (243° C.) after which an elongation of at least 100% can be sufficient.

These standards of heat stability can be provided by filaments which consist essentially of poly(hexamethylene adipamide) containing an effective amount of an antioxidant of the type commonly employed for stabilizing nylon industrial yarns as disclosed for example in the aforementioned Research Disclosure article.

The bulked yarn of this invention has a sufficient number and frequency of surface filament loops to effectively hold the warp cords in place and to stabilize the fabric weave during handling and processing, i.e., an effective amount. This "effective amount" of loops will depend upon their size and distribution, the nature of the weft and warp strands, as well as the handling and processing conditions to which the fabric will be subjected, but such an amount is obtainable under conventional bulking conditions and can be readily established in each case. Stabilization of the loops to resist pull-out requires some care in preparation to avoid undue "drawing" of the filaments and consequent loss of elongation. The loop size and frequency need not be as regular or uniform as is normally required for bulked textile yarns since yarn appearance is not a factor. In tire cord fabrics the prime concern is with uniformity of spacing of the cords, not weft yarn appearance.

A bulked denier increase having sufficient stability of loops for the present application can be obtained through some loss of bulk while still not drawing the filaments too much. For instance, the percent overfeed best suited for the process can be substantially greater than the percent bulk increase in an acceptable yarn produced thereby. For instance, an overfeed of 9% is used to provide bulked yarn of the invention having a bulked denier increase of only about 3% in Example 2. A bulked denier increase of as little as 3% can be effective where the filament loops provide a persistent or continuous enough surface effect to keep the warp cords in place, e.g., as shown by yarn of the FIGURE herein.

A bulked denier increase of from 3 to 20% normally is adequate for this invention, with little further benefit to be gained from an increase of greater than 20%. For combined reliability of performance and efficiency a preferred bulked denier increase range is from 8 to 15%.

Apparatus and process conditions required to obtain the effective amount of stable surface loops are conventional and well known in the art. The actual conditions will vary depending upon the yarn denier, number of filaments, process speed, jet design and so forth as is well known. In general the number and size of loops are controlled by the amount of overfeed and the stability of the loops to tension depends upon turbulence in the jet to provide adequate filament entanglement to lock the loops into place. If desired, loop stability can be increased by imparting true twist to the yarn but twisting adds significantly to the process expense and normally is not required.

By "undrawn" is meant that the filaments have a relatively low molecular orientation or birefringence and upon being stretched can undergo a nonelastic elongation, i.e., "drawing", of at least 100%. Such filaments are commonly made using a low spinning speed such as 900 m/min. or less, without any subsequent drawing step. Suitable undrawn filaments for poly(hexamethylene adipamide) have a birefringence of less than about 0.030. Filaments made under high speed spinning conditions to give what are called spin-drawn or "partially oriented yarns", i.e., POY, and partially drawn yarns are considered to be "undrawn" for this invention provided they have the required high break elongation.

As measured herein, bulked yarn break elongation includes the unrecoverable elongation resulting from removal of filament loops and entanglement (and consequently yarn bulk) upon stretching. This removal of loops can serve as a novel second source of extensibility. This second source of extensibility remains substantially unaffected by exposure to heat alone. It therefore can contribute a more significant portion of the remaining extensibility in a yarn in which filaments have lost some extensibility from being heated versus the greige yarn just off the package.

The filament convolutions and entanglement result in an increase in the original yarn denier called "bulked denier increase" which, as defined in U.S. Pat. No. 3,433,008, is the percent increase above the total denier of the filaments in a straight condition. This increased bulk must be sufficiently stabilized through filament entanglement, preferably while substantially free of true yarn twist, to prevent its removal by normal processing. Normal weft yarn processing and weaving tensions include, for example 0.25 to 0.40 grams/denier (gpd). Under tensions sufficient to fully draw the undrawn filaments, the loops, and consequently the yarn bulk, are normally pulled out before the break elongation is ultimately reached.

To perform effectively as a weft yarn with conventional tire cord warps the yarn of this invention should have a denier of at least about 150; deniers above about 300 are generally unnecessary. To give the desired degree of bulk and stable loopiness the yarn should contain at least about 20 filaments. Filament deniers are preferably within the range of about 2 to 10. Insufficient numbers of filaments make it difficult to obtain the desired stable bulk and filament loops. The larger the denier per filament the less flexible the filaments become, making bulking more difficult. A highly preferred combination is a bulked yarn denier of about 225 to 275 with about 40 to 60 filaments.

The undrawn filaments can be comprised of poly(epsilon-caproamide) or poly(hexamethylene adipamide), preferably containing a chemical stabilizer which reduces their sensitivity to thermal and oxidative degradation. Effective stabilizer compositions include well-known cupric salt/inorganic halide systems such as cupric acetate and potassium iodide. Such stabilizers can be incorporated into the nylon filaments by introducing them into the polymer before filament formation, or into the fibers afterwards, including addition to the weft yarn by way of an adhesive dip composition.

The yarns of this invention can be made using the appropriate undrawn feed yarn in a conventional air jet bulking operation of the type described for example in U.S. Pat. No. 2,852,906. Adequate bulk normally can be obtained within the range of yarn overfeed of about 8 to 20% which under favorable operating conditions can provide stable denier increases within the range of 3 to 15%. Other suitable processing conditions including appropriate yarn finishes and water application prior to bulking are taught for instance in U.S. Pat. No. 3,433,008 (Gage).

Preferred bulked greige yarn break elongations include the range of 200 to 300%. The bulk must be sufficiently stable to tension that sufficient surface loops remain after normal quilling and weaving operations, e.g., involving total yarn tensions within the range of 70 to 100 grams. For its most preferred use in tires the bulked yarn elongation must resist tire fabric hot stretch processing temperatures of 440°–475° F. (227° to 246° C.) for up to 2 minutes in the presence of adhesive dip.

EXAMPLE 1

This example compares the effectiveness of a bulked undrawn yarn of the invention with the nonbulked undrawn feed yarn as weft (pick) yarns in a tire cord fabric.

An undrawn yarn of poly(hexamethylene adipamide) containing a conventional cupric acetate/potassium iodide antioxidant is prepared by melt spinning and winding up the filaments at about 905 ypm (828 mpm). The polymer has a relative viscosity of about 37.7. The yarn has a denier of about 230 and contains 34 filaments of round cross section.

The yarn is air-jet bulked in a conventional manner using a Type XIV jet device of the type used commercially for texturing textile yarns and equipped with a floating baffle. The jet is shown in FIGS. 9 and 10 of U.S. Pat. No. 4,157,605 and the baffle in U.S. Pat. No. 3,835,310. Test samples are prepared wet and dry, with and without water application to the yarn prior to the jet. The yarn bulks with some difficulty because of its relatively low filament count, high dpf and high elongation which factors tend to allow some loops and filament entanglement to be pulled out. Optimum bulking conditions for the wet yarn are found using an overfeed of about 16%; and about 10.9% for the dry yarn. The maximum available air pressure of 140 psig (965 kPa) is used in each case with a windup speed of 292.5 ypm (267 mpm). Feed roll speed for the former is 340 ypm (311 mpm) and for the latter 324.5 ypm (297 mpm). Winding tension is maintained at a minimum to help avoid bulk pullout (10–12 grams maximum wet, and 8–10 est. dry).

The bulked yarns are comprised of continuous filaments which are individually convoluted into coils, loops and whorls at random intervals along their lengths and are characterized by the presence of a multitude of crunodal and other loops persistently spaced along the yarn surface.

To test their effectiveness as pick yarns in tire cord fabrics the two test items, and the nonbulked feed yarn, as a control, are quilled for weaving with a conventional polyester tire cord warp. A minimum quilling tension is used, estimated at about 20–25 grams. Fabrics 6 in. (15.2 cm.) wide are woven of each of the three items using 8 picks per inch (3.1 per cm.) at three different shuttle tensions: about 6 grams (low), about 15 grams (normal) and about 35 grams (high). For each set of tensions, fabrics of the bulked pick yarns are observed to be stable whereas the fabrics of the nonbulked control yarn (representative of U.S. Pat. No. 3,395,744) are found to unravel badly in handling.

The fabric samples are subjected to conventional adhesive dipping and heat stretching (in warp direction) treatments on a Kidde machine having three ovens at 470°/320°/440° F. (243°/160°/227° C.) with a 60 second exposure in each and a conventional blocked isocyanate/epoxide adhesive precoat being applied before the first oven and a conventional resorcinol/formaldehyde/latex dip overlay being applied before the second oven.

Tensile properties at the various stages are measured for the wet-processed item and are shown in Table 1.

TABLE 1

| | Break Elongation (%) | Break Strength (gms) |
|---|---|---|
| As-spun | 203 | 314 |
| Bulked | 277* | 311 |
| Quilled | 261 | 327 |
| Woven | 253 | 305 |
| Kidde Treated | 127 | 180 |

*For 16% overfeed, this greater than 16% increase in elongation vs. as-spun elongation is unexplained.

From Table 1 it is seen that the breaking elongation of the weft yarn remains greater than 200% through weaving and greater than 100% even after the fabric hot stretching coated with adhesive.

The static and slow-speed dynamic friction characteristics of the wet-bulked yarn are measured in a standard way against a slowly turning polyester tire cord-covered roll and found to be very similar to a commercial core-spun weft yarn having an undrawn nylon core and a cotton covering as referred to previously. The friction values are shown in Table 2.

TABLE 2

YARN-TO-CORD FRICTION

| | Speed (cm/sec) | | | |
|---|---|---|---|---|
| | 0.0016 | 0.016 | 0.16 | 1.6 |
| Nylon/Cotton Core-Spun | 0.250 | 0.250 | 0.250 | 0.245 |
| As-spun (nonbulked) | 0.210 | 0.210 | 0.200 | 0.190 |
| 16% Bulked | 0.245 | 0.240 | 0.230 | 0.220 |

From the above results it is concluded that the bulked undrawn yarn can be an effective weft yarn replacement for the core-spun yarn and much better than the nonbulked control.

EXAMPLE 2

This example demonstrates the use of a yarn of this invention in the making of a fabric for light truck tires under commercial processing conditions.

An undrawn heat-stabilized 66-nylon feed yarn (of similar composition used in Example 1) is prepared by melt spinning poly(hexamethylene adipamide) at a windup speed of 900 ypm (823 mpm) and a windup tension estimated at 8–10 grams. The yarn has a denier of 236, 50 filaments, a breaking strength of 378 grams, a tenacity of 1.6 gpd, a breaking elongation of 259% (measured after aging for about 2 weeks) and contains 0.36% by weight of a finish. The yarn is bulked with air using a slightly modified version of a multiorifice forwarding jet substantially of the type described in U.S. Pat. No. 3,364,537 FIGS. 11 and 12. The bulking conditions include an overfeed of about 9% and applying water to the feed yarn at the rate of 30 ml/min using a bulking fluid air pressure of 175 psig (1206 kPa), a windup speed of 660 ypm (604 mpm) and a windup tension of 20 grams or less. The bulked yarn has a breaking strength of 351 g, a tenacity of 1.4 gpd and an elongation of 254%. The bulked yarn denier is 243 corresponding to an increase of about 3%.

The bulked yarn is characterized by the persistent presence of a multitude of crunodal loops of various sizes irregularly spaced along the yarn surface interspaced with larger arched loops, all caused by filaments being individually convoluted into coils, loops and whorls at random intervals along their lengths. As compared to a conventional commercially acceptable bulked textile yarn the crunodal loops are more sparsely positioned along the yarn, not unexpected for only a 3% bulk increase. Many of the loops are relatively large with respect to the overall yarn diameter. See the FIGURE which shows six representative sections 10 of a continuous portion of this yarn wrapped on a card and a portion of a linear scale with one millimeter spaced markings 12 for reference. The size, shape, type and spacing of the loops are all highly irregular but result in a persistent surface effect sufficient for stabilization of warp tire cords in a fabric.

In preparation for weaving the yarn is quilled with the quilling tension ranging from 50–100 grams fluctuating with the quilling motion. The yarn is used as the filling or weft to weave a tire cord fabric in which the warp contains 24 ends/in (9.4/cm) of a commercial polyester tire cord of 1300/$\frac{1}{3}$ construction suitable for use in light truck tires. The weft contains 1.7 picks per inch (0.7/cm). The fabric is woven at a speed of about 3 yds/min (2.7 mpm/meter) using a fabric width of 63$\frac{1}{2}$ in. (161 cm). Weaving is normal except for some difficulty in getting a clean cut during quill transfer due to the high weft yarn elongation.

Control fabrics are prepared under substantially the same conditions using as the filling a 23/1 cc commercial core spun cotton/nylon yarn and a commercial 26/1 cc rayon yarn. Warp displacement in the fabrics is noted to be significantly less with the bulked yarn of the invention giving a smoother fabric than either of the control pick yarns. The bulked yarn was observed to have a tendency to flatten out more at cross-overs with the warp cords.

The fabrics are dipped and hot stretched on a standard Litzler machine using standard polyester conditions for cords of this weight and a double dip adhesive as in Example 1. The fabric is processed at a speed of 57 ypm (52 mpm) with an exposure time of about 56 seconds in each of three ovens. The oven temperatures in order encountered are 480°/485°, 360°/365° and 460°/460° F. (249°/252°, 182°/185° and 238°/238° C.) respectively. The applied stretch in the ovens is plus 7.5%, minus 1.2% and minus 3.2% respectively.

The residual break elongation for the test yarn of the invention after hot stretching of the fabric is 158%, well above the desired 100% minimum considered desirable for conventional radial green tire expansion. After exposure in an oven at constant length at 470° F. (243° C.) for 2 minutes the yarn of the invention has an elongation of 167%.

Some nonuniformity in spacing of the pick yarns of the invention is observed during the hot stretching. This is found however not to affect uniformity of cord spacing.

The treated fabrics are calendered with rubber using a standard commercial carcass stock for nylon and polyester tires. The pick yarns' control of cord spacing is tested through the expansion stage of a green tire. A carcass is prepared for a single ply radial tire of FR-78-14 size. And the green carcass is expanded conventionally but no belt, tread or sidewall rubber is applied.

For the bulked pick yarn of the invention no yarn breakage is observed during the expansion, a visually uniform surface is retained. Based upon the increase in distance between the cords in the area of maximum expansion it is estimated that the pick yarns are elongated about 70% during the expansion. Uniform cord spacing is maintained, resulting in a smooth uniform green tire appearance which is judged at least comparable in quality to the commercial core-spun control.

With the rayon pick yarns, as expected, during expansion the yarns break in at least 4 or 5 areas resulting in nonuniform cord spacing and a lumpy, nonsmooth appearance. In normal use, such nonextensible pick yarns are broken in a special treatment prior to expansion.

We claim:

1. An extensible bulked yarn consisting essentially of entangled, individually convoluted, undrawn, synthetic, continuous filaments of poly(hexamethylene adipamide) or poly(epsilon-caproamide) and characterized by a multitude of stable crunodal filament loops spaced along its surface and by a break elongation of at least 150%.

2. A bulked yarn of claim 1 having a bulked denier increase of from 3 to 15%.

3. A yarn of claim 2 having a break elongation of from 200 to 300% in the greige state.

4. A yarn of claim 1 which retains a break elongation after heating in air under tension at 440° F. for two minutes of at least 100%.

5. A yarn of claim 4 wherein the undrawn filaments are comprised of poly(hexamethylene adipamide) containing as an antioxidant a cupric salt and a halogen salt.

6. A yarn of claim 1 having a bulked denier of from 150 to 300 and containing at least 20 filaments.

7. A yarn of claim 5 wherein the undrawn filaments consist essentially of poly(hexamethylene adipamide).

8. A yarn of claim 1 containing an effective amount of surface filament loops to be a weft yarn for a tire cord fabric.

9. A woven greige fabric having a weft comprised of (1) an extensible bulked yarn consisting essentially of entangled, individually convoluted, undrawn, synthetic, continuous filaments of poly(hexamethylene adipamide) or poly(epsilon-caproamide) which form a multitude of stable crunodal filament loops persistently along the yarn surface and the yarn has a break elongation of at least 150% and (2) a warp comprised of tire cords.

10. A hot-stretched fabric of claim 9 wherein the weft yarns have a break elongation of at least 100%.

* * * * *